US007494246B2

(12) United States Patent
Harbers et al.

(10) Patent No.: US 7,494,246 B2
(45) Date of Patent: Feb. 24, 2009

(54) THIN LUMINAIRE FOR GENERAL LIGHTING APPLICATIONS

(75) Inventors: Gerard Harbers, Sunnyvale, CA (US); Serge Bierhuizen, Milpitas, CA (US)

(73) Assignee: Philips Lumileds Lighting Company, LLC, San Jose, CA (US)

( * ) Notice: Subject to any disclaimer, the term of this patent is extended or adjusted under 35 U.S.C. 154(b) by 75 days.

(21) Appl. No.: 11/758,952

(22) Filed: Jun. 6, 2007

(65) Prior Publication Data

US 2008/0304250 A1 Dec. 11, 2008

(51) Int. Cl.
*F21V 21/00* (2006.01)

(52) U.S. Cl. ..... 362/249; 362/223; 362/225; 362/300; 362/301

(58) Field of Classification Search ..... 362/97, 362/222–223, 225, 240, 249, 300–301
See application file for complete search history.

(56) References Cited

U.S. PATENT DOCUMENTS 6,729,746 B2 * 5/2004 Suehiro et al. ..... 362/241

* cited by examiner

*Primary Examiner*—Sandra O'Shea
*Assistant Examiner*—Jason Moon Han
(74) *Attorney, Agent, or Firm*—Patent Law Group LLP; Brian D. Ogonowsky

(57) ABSTRACT

High power white light LEDs are distributed within a thin reflective cavity. The cavity depth may be less than 3 cm and, in one embodiment, is about 1 cm. A light output surface of the cavity is a flat reflector with many small openings. A small plastic lens is positioned over each opening for causing the light emitted from each opening to form a cone of light between approximately 50-75 degrees. Alternatively, each hole may be shaped to be a truncated cone to control the dispersion. The light emitted by the LEDs is mixed in the cavity by reflecting off all six reflective walls of the cavity. The light will ultimately escape through the many holes, forming a relatively uniform pattern of light on a surface to be illuminated by the luminaire.

23 Claims, 3 Drawing Sheets

THIN LUMINAIRE FOR GENERAL LIGHTING APPLICATIONS

FIELD OF THE INVENTION

This invention relates to general purpose lighting using high power light emitting diodes (LEDs) and, in particular, to a very thin luminaire (i.e., a light fixture with a light source) using LEDs for general purpose lighting.

BACKGROUND

Fluorescent light fixtures are the most common type of light fixture for office and shop lighting. Fluorescent light fixtures are also used under shelves, in or under cabinets, or in other situations where a relatively shallow, elongated light is desired. A fluorescent light bulb is typically housed in a diffusively reflective rectangular cavity with an open top. A clear plastic sheet with a molded prism pattern is affixed over the opening. The plastic sheet somewhat diffuses the light and directs the light emission downward onto the surface to be illuminated. Since fluorescent bulbs are generally greater that one-half inch in diameter, such fixtures typically exceed one inch in depth. For small areas to be illuminated, the depth of a fluorescent fixture becomes unsightly.

It would be desirable to substantially reduce the thickness of a white light source for replacing such fluorescent light fixtures.

SUMMARY

An array of high power white light LEDs is positioned on the base surface of a thin reflective cavity, having length and width dimensions slightly larger than the array of LEDs. The array of LEDs may be a linear array, a two dimension array, or any other pattern. The LEDs may be mounted on one or more thin circuit board strips that electrically couple the LEDs to a power supply terminal. Each LED is typically 2-7 mm in height. The cavity depth is made to be about 2-5 times the thickness of the LEDs, such as about 0.5-3 cm.

The light output surface of the cavity is a reflector with many more openings than the number of LEDs (e.g., 4-25 times the number of LEDs). The openings may be in a one dimensional array, a two dimensional array, or distributed to best form a uniform light emission pattern. Over each opening is a small plastic lens for causing the light emitted through the opening to form a cone of light between approximately 50-75 degrees, and preferably 60 degrees. The angle is determined by where light is half as bright as the peak brightness within the angle.

The light emitted by each LEDs within the cavity is generally a Lambertian pattern. This emitted light is mixed in the cavity by reflecting off all six reflective walls of the cavity. The light will ultimately escape through the many holes, forming a relatively uniform pattern of light on a surface to be illuminated by the luminaire.

For additional light mixing in the cavity or if the cavity is made ultra thin, side-emitting LEDs may be used. Side emission may be obtained using a side-emitting lens or by positioning a small reflector over the top surface of the LED die.

Instead of a lens over each opening, each opening may be formed as a truncated cone, expanding toward the light exit. The area of the output of the cone compared to the input of the cone is set to output light through approximately a 60 degree angle. Any angle between 45-90 degrees may be satisfactory, depending on the application.

The white light LEDs may be blue light LEDs with a yellow phosphor coating, whereby the combination of the yellow light and the blue light leaking through the phosphor creates white light. The white light may also be created using a blue LED with red and green phosphors surrounding it. There are many ways to apply a phosphor over an LED.

In another embodiment, the LEDs are mounted on the reflective light output surface of the cavity between the openings. In this way, the light from the LEDs cannot directly enter any opening but must first reflect off an inner surface of the cavity before exiting through the openings. This improves the mixing and uniformity of the light output. The reflective light output surface may be formed of reflective aluminum so as to also act as a heat sink for the LEDs. In one embodiment, the LEDs output white light using a phosphor over the LED. In another embodiment, the LEDs output blue light, and at least the base surface of the cavity is coated with a phosphor so that the phosphor emission in conjunction with the blue component produces white light through the openings. This is possible since the blue LED light does not directly emit through an opening.

DETAILED DESCRIPTION

Figure 1:
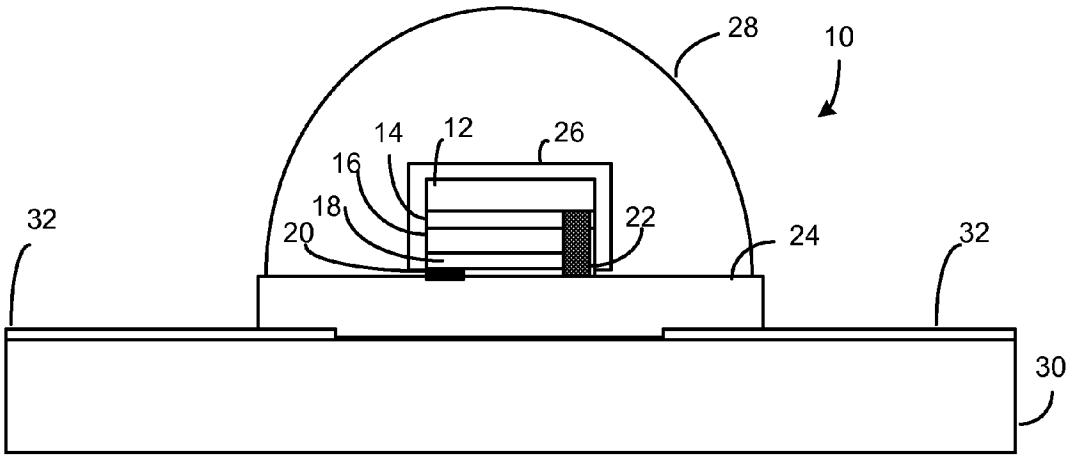
FIG. 1 is a cross-sectional view of a conventional high power LED emitting white light.

FIG. 1 is a cross-section of a conventional LED 10 that generates white light by combining a blue light, generated by the LED die, with a yellow light generated by a phosphor, such as a YAG phosphor. Such LEDs for illumination are commercially available with a light output of about 10-100 lumens.

In the examples used, the LED die is a GaN-based LED, such as an AlInGaN LED, for producing blue light. An LED producing UV light may also be used with suitable phosphors. The LED die has an n-type cladding layer 12, and active layer 14, a p-type cladding layer 16, and a p-type contact layer 18, on which is formed a metal electrode 20. The n-type layer 12 is contacted by a metal electrode 22 that extends through an opening in the p-layers and the active layer 14. The LED die is mounted on a ceramic submount 24 having top electrodes that are thermosonically welded to the LED die electrodes. The submount 24 has bottom electrodes connected to the top electrodes by conductive vias (not shown) through the submount 24.

A layer of YAG phosphor 26 is formed over the LED die by any suitable process, such as electrophoresis (a type of plating process using an electrolyte solution) or any other type of process. A preformed phosphor plate positioned over the top surface of the LED die can be used instead.

A silicone or plastic lens 28 encapsulates the LED die. The LED die, submount, and lens are considered to be the LED 10 for purposes of this disclosure.

The total height of the LED 10, including the lens 28 and submount 24, is typically in the range of 2-7 mm. If the LED 10 were housed in a surface mount package with a plastic body and lead frame, the height may exceed 7 mm. For ultrathin LEDs, with their growth substrate (typically sapphire) removed and no lens, the thickness, including the submount, may be less than 1 mm. Such ultrathin LEDs may also be used in the invention. The width of a packaged LED is on the order of 5 mm.

The submounts of a number of LEDs are soldered to a circuit board 30, having metal traces 32 for interconnecting multiple LEDs and for coupling to a power supply. The circuit board 30 is preferably formed as a narrow strip. The LEDs may be connected in a combination of serial and parallel. The circuit board 30 body may be an insulated aluminum strip for conducting heat away from the LEDs. The circuit board 30 typically has a thickness less than 2 mm.

Examples of forming LEDs are described in U.S. Pat. Nos. 6,649,440 and 6,274,399, both assigned to Philips Lumileds Lighting Company and incorporated by reference.

The particular LEDs formed and whether or not they are mounted on a submount is not important for purposes of understanding the invention.

Figure 2:
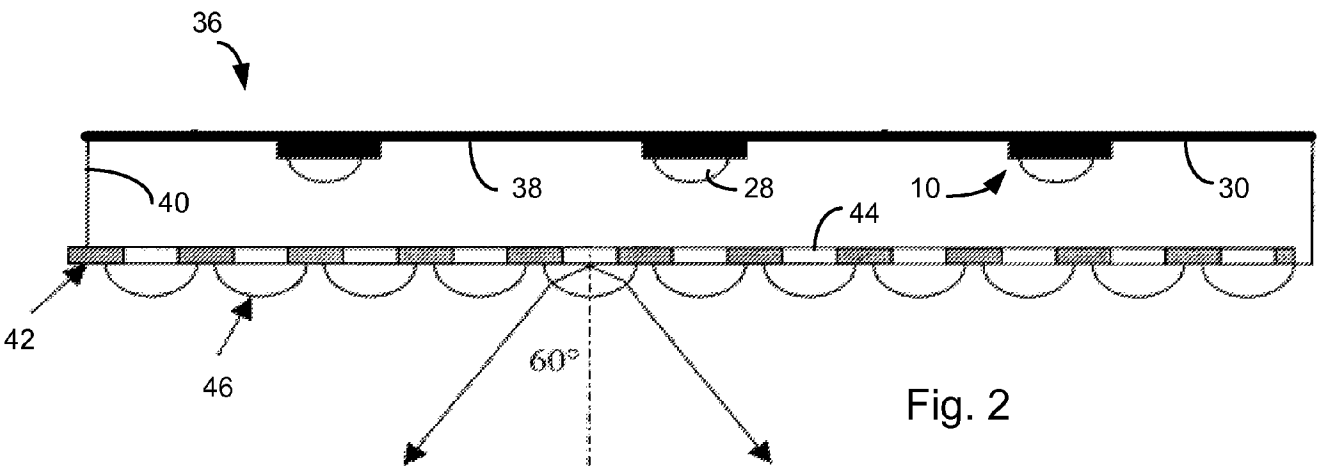
FIG. 2 is a cross-sectional view of LEDs mounted in a reflective cavity with light exit holes in a surface of the cavity, in accordance with one embodiment of the invention.

FIG. 2 is a cross-sectional view of three LEDs 10, mounted on a circuit board 30 strip, within a thin reflective cavity 36. Any number of LEDs 10 may be used, depending on the desired dimensions and light output of the luminaire. With high brightness LEDs, the pitch may be on the order of 1 inch or greater to replicate the light power of a fluorescent bulb. The length of the cavity will typically range from 4 inches to several feet. Multiple circuit board strips may be connected together to achieve the desired length and width. A current source (not shown) is coupled to the power leads of the circuit board strips.

The base surface 38 and side walls 40 of the cavity 36 are reflective. The reflection may be specular (like a mirror) or diffused. For example, the wall material may be polished aluminum, or have a reflective film coating, or be coated with a reflective-diffusing white paint. The circuit board 30 may also have a fairly reflective top surface, and the circuit board 30 may constitute a relatively small portion of the bottom surface of the cavity 36. If the circuit board comprises a relatively large area, the circuit board is considered to form the bottom surface of the cavity 36.

The light output surface of the cavity 36, opposite to the LED mounting surface, is formed of a reflective sheet 42 having many more holes 44 than the number of LEDs. There may be 4 to 25 holes, or more, per LED, spaced for uniform illumination. The reflective sheet 42 may be rigid plastic with a reflective film or may be thin metal. The area of the holes makes up preferably 10%-50% of the entire area of the sheet 42. Each hole is preferably approximately 1-2 mm, which is between about ⅕ to ⅓ the diameter of an average LED lens. The diameter of each hole will depend on the number of holes in order to provide a sufficient total opening in the reflective sheet 42 to supply the desired overall brightness of the luminaire. The diameter of each hole may range from 0.5 mm-3 mm.

A plastic, glass, or silicone lens 46 overlies each hole 44. The shape of the lens 46 causes the light output of each hole 44 to have a 60 degree spread (determined by the angle of half the brightness at the peak). A total dispersion angle of between 45-90 degrees may be satisfactory for most applications.

The lenses 46 may be formed by a simple molding step, where the top surface of the reflective sheet 42 is brought in contact with a mold having indentions, defining each lens, filled with a liquid lens material. The lens material may totally or partially fill each hole 44 and adheres to the reflective sheet 42. The lens material is cured by heat, UV, or other means (depending on the material), and the reflective sheet 42 is removed from over the mold with the lenses 46 affixed to the sheet 42.

In another embodiment, the lenses 46 may be preformed and adhered to the reflective sheet 42 using any means.

The farther the reflective sheet 42 is away from the LEDs 10, the more mixing of light is done in the cavity 36 and the more uniform the resulting light emission will be. In one embodiment, the thickness of the cavity 36 is 2-10 times the height of an individual LED, or anywhere from 0.5-7 cm. The arrangement of holes 44 may be equally spaced or spaced so that the density of holes 44 substantially over an LED is less than the density of holes 44 further from an LED. This equalizes the output of light from different areas of the reflective sheet 42. The sizes of the holes 44 may also be varied to adjust the amount of light output from each hole to obtain better uniformity.

Additionally, the lens 28 over each LED mounted in any of the cavities described herein may be shaped so that the light pattern is not Lambertian but more side emitting to reduce the light output intensity from holes 44 directly over an LED (due to direct illumination) and to increase the light mixing in the cavity to improve the uniformity of light output from the cavity.

Figure 3A:
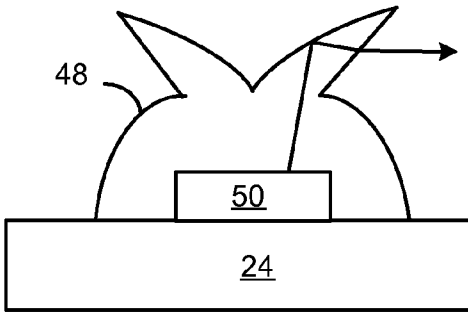
FIGS. 3A and 3B illustrate two types of side-emitting LEDs that can be mounted in the reflective cavities described herein.
Figure 3B:
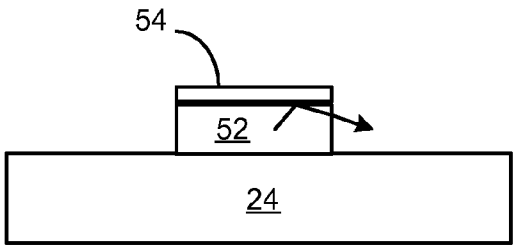

FIG. 3A illustrates one type of side-emitting lens 48 over a white light LED 50. FIG. 3B illustrates an ultra-thin, side-emitting LED 52 that generates white light, where a reflective film 54 is deposited over the phosphor layer on the LED die. Such a side-emitting LED may have its growth substrate removed and can be made to be less than 1 mm in height. Either embodiment may be mounted in the reflective cavity.

Figure 4:
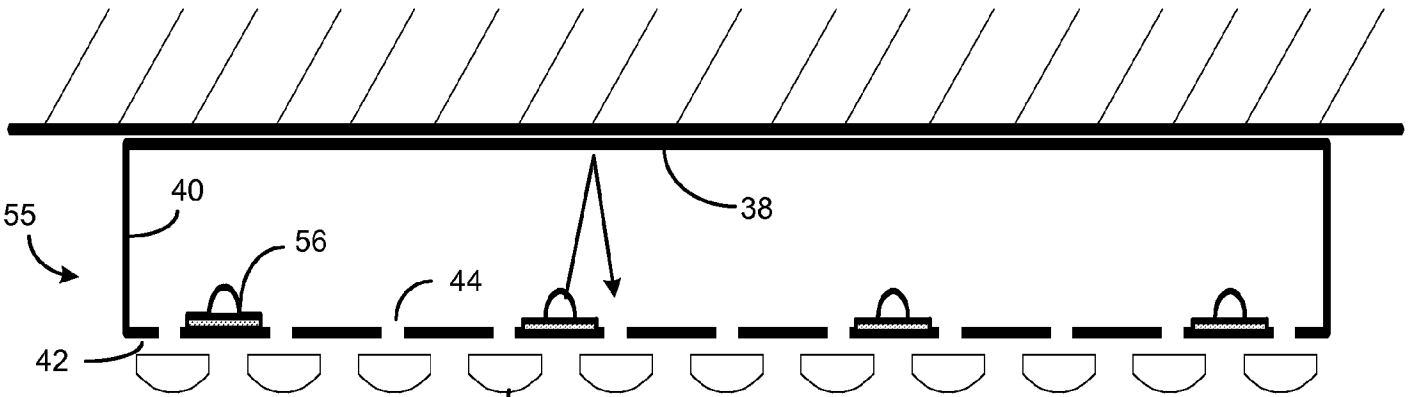
FIG. 4 is a cross-sectional view of LEDs mounted on the reflective light output surface of the cavity, in accordance with another embodiment of the invention.

FIG. 4 is a cross-sectional view of another embodiment of a reflective cavity 55, where white light LEDs 56 are mounted on the reflective sheet 42 of the cavity between the openings 44. In this way, the light from the LEDs 56 is guaranteed to reflect off at least the base surface 38 of the cavity before being emitted through a hole 44. This improves the uniformity of the light passing through the openings, which allows for a thinner cavity, such as 2-4 times the thickness of the LEDs 56. The reflective plate 42 is preferably made of highly reflective enhanced aluminum, such as manufactured by Alanod Ltd, so as to act as a heat sink for the LEDs 56. The reflective sheet 42 is then cooled by ambient air. The holes may be drilled, punched, or laser formed.

In another embodiment, the LEDs 56 may output blue light (i.e., no phosphor over the LED die), and at least the base surface 38 of the cavity is coated with a phosphor that generates a white light when combined with the blue LED light. The phosphor coating may be spray painted or screen printed with different phosphors. The phosphor(s) may, for example, be YAG (yellow-green) or a combination of a YAG and red phosphor (such as CaS or ECAS) for a warmer light. The side inner surfaces of the cavity may also be coated with the phosphor.

Figure 5:
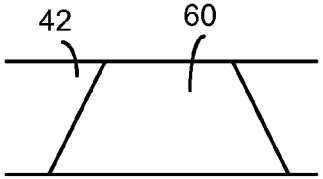
FIG. 5 is a cross-sectional view of a hole having a truncated cone shape.

FIG. 5 is a cross-sectional view of a hole 60 formed in the reflective sheet 42 having a truncated cone shape. The area of the output of the cone compared to the input of the cone scales with the required emission pattern. The output area compared to the input area is approximately given by the relation:

$$A_{output}=A_{input}\sin^2\theta \quad \text{(eq. 1)}$$

with θ the half angle of the required output cone.

In FIG. 5, the area of the output of the cone compared to the input of the cone is set to output light through approximately a 60 degree angle. Any angle between 45-90 degrees may be satisfactory. In such a case, no lens is needed over each hole. Holes without lenses increase the air flow in the cavity 36 to help cool the LEDs. Forming shaped holes, however, is more difficult than cylindrical holes. The holes may be made by drilling, coining, etching, laser machining, or sandblasting through a mask.

The holes 44/60 in all embodiments are generally circular for uniform light emission, but can have other shapes, such as ovals, to further shape the light emission so that the light emission angle may be 60 degrees in one direction and only 30 degrees in another direction. The holes may also include slits to create a long thin light pattern.

The light emanating from each hole 44 will increasingly blend as the object to be illuminated is moved further from the luminaire.

Figure 6:
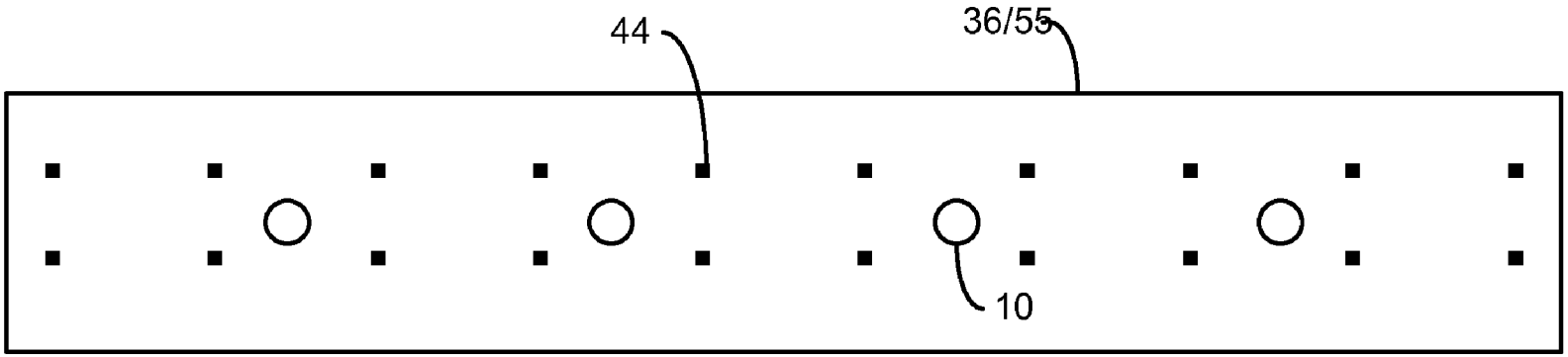
FIG. 6 is a top down view of one embodiment of a luminaire with a linear array of LEDs.
Figure 7:
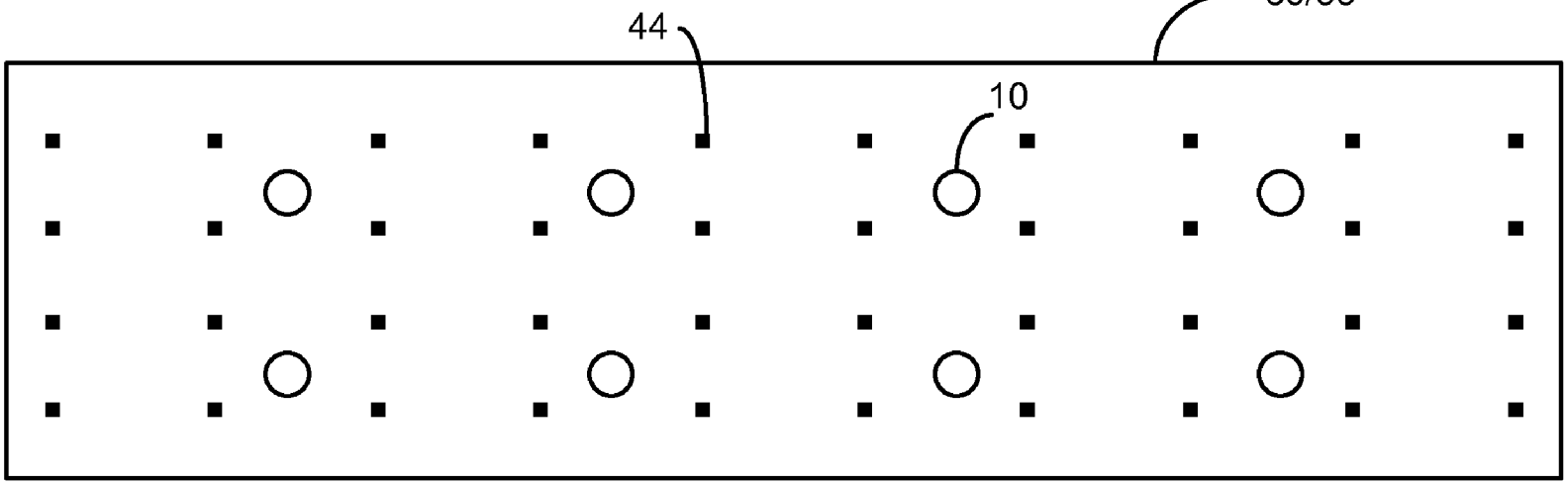
FIG. 7 is a top down view of one embodiment of a luminaire with a two-dimensional array of LEDs.

FIGS. 6 and 7 are top down views of the luminaire showing different arrangements of the LEDs 10. The LEDs 10 may be on the base surface or on the reflective sheet, and the LEDs may or may not be side-emitting. Only four equally spaced holes 44 per LED 10 are shown for simplicity. In the embodiments of FIGS. 6 and 7, no holes 44 are directly over an LED so as to ensure some degree of light smoothing provided by the cavity 36/55 for each hole 44. The luminaire can have any number of rows of LEDs, and the LEDs need not be uniformly spaced, with the goal of generating a uniform light output of the luminaire at, for example, a distance of one foot. The shape of the luminaire may be anything, such as a square, a rectangle, a circle, etc.

In one embodiment, the preferred uniformity of light provided by the luminaire is within 50% of the peak brightness within a flat area the size of the luminaire located 1 foot under the luminaire. This quality is considered to be substantially uniform illumination since there will be no objectionable sharp transitions of brightness across the illuminated object, and the observer may not notice a diminishing of the brightness along the edges of the object. In another embodiment, where more holes are used, the uniformity is 75% across the object. In another embodiment, the uniformity is 90%.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A luminaire for illuminating a remote object comprising:

a cavity having a reflective base surface and reflective side walls;

a plurality of light emitting diodes (LEDs) affixed within the cavity; and the cavity having a flat reflective light output surface, opposite to the reflective base surface, containing a plurality of light emitting holes, there being more holes than LEDs, wherein the holes make up at least 10% of a total surface area of the top surface of the cavity, wherein light emitted by the luminaire in the vicinity of substantially each hole has a controlled dispersion angle of between about 45-90 degrees, as measured by the angle where a light brightness is one-half of a peak brightness within the angle, wherein a lens is disposed over each hole to provide the control dispersion angle, the cavity having a depth of less than 5 cm, wherein light emitted by the luminaire provides a substantially uniform illumination of a flat object a particular distance away from the flat reflective light output surface of the luminaire.

2. The luminaire of claim 1 wherein the substantially uniform illumination of a flat object a particular distance away from the flat reflective light output surface of the luminaire comprises:

the luminaire illuminating a flat surface of an object having a dimension equal to a dimension of the light output surface of the luminaire, the flat surface of the object being 1 foot away from the light output surface of the luminaire, the illumination of every area of the flat surface of the object being within 75% of the peak brightness of the illumination of the flat surface of the object.

3. The luminaire of claim 1 wherein substantially each hole has a controlled dispersion angle of less than about 60 degrees, as measured by the angle where a light brightness is one-half of a peak brightness within the angle.

4. The luminaire of claim 1 further comprising a circuit board supporting a plurality of the LEDs.

5. The luminaire of claim 1 wherein the LEDs are mounted over the base surface of the cavity.

6. The luminaire of claim 1 wherein the LEDs are mounted over the flat reflective light output surface of the cavity.

7. The luminaire of claim 1 wherein a pitch of the LEDs is at least about 2.5 cm.

8. The luminaire of claim 1 wherein the LEDs are arranged in a single straight line within the cavity.

9. The luminaire of claim 1 wherein the LEDs are arranged in a two-dimensional array within the cavity.

10. The luminaire of claim 1 wherein substantially each hole is shaped to be other than cylindrical to provide the controlled dispersion angle.

11. The luminaire of claim 1 wherein substantially each hole is shaped to be other than cylindrical.

12. The luminaire of claim 1 wherein the cavity has a depth of less than ten times a height of a single LED in the cavity.

13. The luminaire of claim 1 wherein the cavity has a depth of less than five times a height of a single LED in the cavity.

14. The luminaire of claim 1 wherein the cavity has a depth of less than about three cm.

15. The luminaire of claim 1 wherein the cavity has a depth of less than about one cm.

16. The luminaire of claim 1 wherein the holes are arranged in an orderly pattern.

17. The luminaire of claim 1 wherein a density of holes substantially over each LED is less than a density of holes away from over each LED.

18. The luminaire of claim 1 wherein inner walls of the cavity are substantially specular.

19. The luminaire of claim 1 wherein inner walls of the cavity are diffusing.

20. The luminaire of claim 1 wherein the cavity is rectangular and elongated.

21. The luminaire of claim 1 wherein the LEDs comprise:
LED dies that emit blue light; and a phosphor over at least a portion of each LED die that emits a light that, when combined with blue light, produces white light.

22. The luminaire of claim 1 wherein the LEDs comprise:
LED dies that emit blue light; and a phosphor coating over at least one inner surface of the cavity that emits a light that, when combined with blue light, produces white light.

23. The luminaire of claim 1 wherein the LEDs are side-emitting LEDs.

* * * * *